US005160815A

United States Patent [19]

Prater

[11] Patent Number: 5,160,815

[45] Date of Patent: Nov. 3, 1992

[54] MEGAPHONE APPARATUS

[76] Inventor: Michael A. Prater, Rte. 2, Box 356-L, La Vernia, Tex. 78121

[21] Appl. No.: 719,748

[22] Filed: Jun. 24, 1991

[51] Int. Cl.[5] ..... G10K 11/00

[52] U.S. Cl. ..... 181/182; 181/187; 181/188; 181/189; 181/192

[58] Field of Search ..... 181/177, 181, 182, 187, 181/188, 189, 192, 152, 159; 84/330, 410

[56] References Cited

U.S. PATENT DOCUMENTS 4,040,503 8/1977 Hino et al. ..... 181/192
4,329,905 5/1982 Lloyd ..... 181/177 X

*Primary Examiner*—Michael L. Gellner
*Assistant Examiner*—Khanh Dang
*Attorney, Agent, or Firm*—Leon Gilden

[57] ABSTRACT

A megaphone apparatus includes an elongate conical conduit directed into an outwardly flaring forward body portion. The conduit includes an entrance opening, with the flaring body including a plurality of exit openings defined by a central outlet conduit coaxially aligned with the inlet conduit, with a plurality of right and left branch conduits extending laterally to each side of the central conduit aligned in a single plane along a common diameter of the various conduits. A modification of the invention includes various residence modulating caps selectively positionable over the conduits to include a flexible web, with at least one slit directed diametrically therethrough, and including a plurality of pockets arranged in a spaced relationship relative to the slit to include a flexible rod selectively positioned within each pocket as desired for varying modulation of the flexible web of each cap in use.

4 Claims, 4 Drawing Sheets

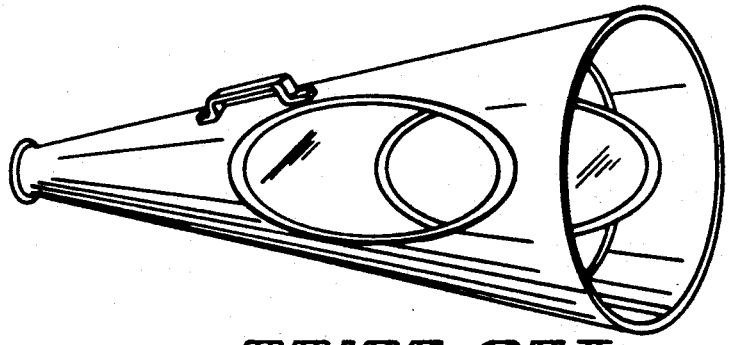
PRIOR ART
Fig 1
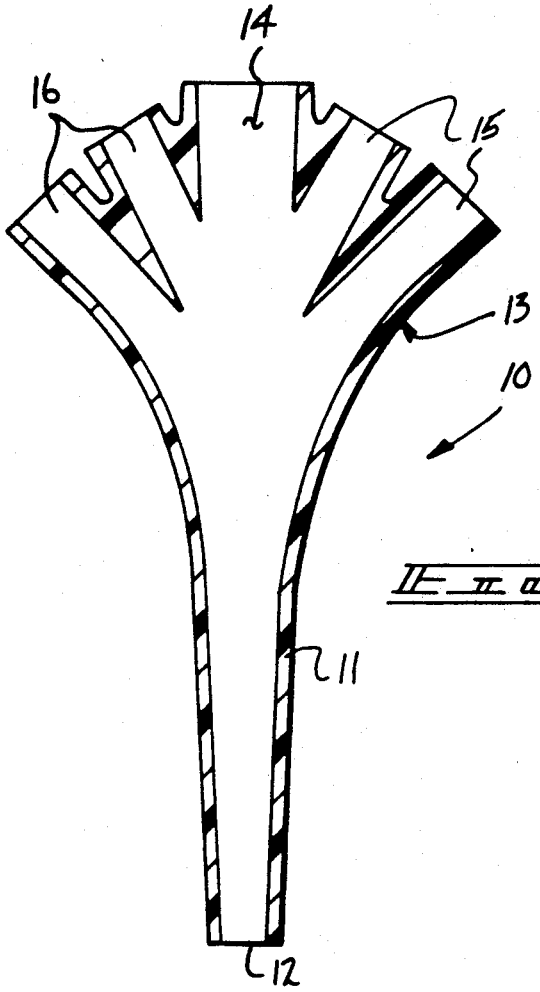
Fig 3
Fig 2
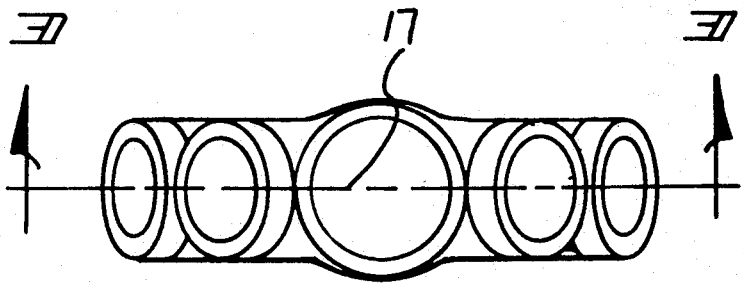

MEGAPHONE APPARATUS

BACKGROUND OF THE INVENTION

1. Field of the Invention

The field of invention relates to megaphone apparatus, and more particularly pertains to a new and improved megaphone apparatus wherein the same is arranged to provide enhanced voice dispersion in use in a megaphone construction.

2. Description of the Prior Art

Megaphone apparatus of various types are utilized in the prior art particularly at spectator events to direct messages at a level to be heard above typical environmental noise at the crowded events. Such apparatus is typified in U.S. Pat. No. 4,329,905 to Lloyd wherein a megaphone apparatus utilizes vibrating membranes mounted within the central cone of the apparatus.

U.S. Pat. No. 1,538,321 to Gunn sets forth a voice transmitting device on a mouthpiece and an output tube to direct voice therethrough.

U.S. Pat. No. 1,581,972 to Mason sets forth a conventional type megaphone apparatus of a conical configuration throughout the body length.

As such, it may be appreciated that there continues to be a need for a new and improved megaphone apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of megaphone apparatus now present in the prior art, the present invention provides a megaphone apparatus wherein the same utilizes a plurality of outlet voice directing conduits in communication with a central body conduit to disperse voice in use of the apparatus. As such, the general purpose of the present invention, which will be described subsequently in greater detail, is to provide a new and improved megaphone apparatus which has all the advantages of the prior art megaphone apparatus and none of the disadvantages.

To attain this, the present invention provides a megaphone apparatus including an elongate conical conduit directed into an outwardly flaring forward body portion. The conduit includes an entrance opening, with the flaring body including a plurality of exit openings defined by a central outlet conduit coaxially aligned with the inlet conduit, with a plurality of right and left branch conduits extending laterally to each side of the central conduit aligned in a single plane along a common diameter of the various conduits. A modification of the invention includes various residence modulating caps selectively positionable over the conduits to include a flexible web, with a least one slit directed diametrically therethrough, and including a plurality of pockets arranged in a spaced relationship relative to the slit to include a flexible rod selectively positioned within each pocket as desired for varying modulation of the flexible web of each cap in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved megaphone apparatus which has all the advantages of the prior art megaphone apparatus and none of the disadvantages.

It is another object of the present invention to provide a new and improved megaphone apparatus which may be easily and efficiently manufactured and marketed.

It is a further object of the present invention to provide a new and improved megaphone apparatus which is of a durable and reliable construction.

An even further object of the present invention is to provide a new and improved megaphone apparatus which is susceptible of a low cost of manufacture with regard to both materials and labor, and which accordingly is then susceptible of low prices of sale to the consuming public, thereby making such megaphone apparatus economically available to the buying public.

Still yet another object of the present invention is to provide a new and improved megaphone apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art megaphone apparatus.

FIG. 2 is an orthographic frontal view, taken in elevation, of the megaphone apparatus.

FIG. 3 is an orthographic view, taken along the lines 3—3 of FIG. 2 in the direction indicated by the arrows.

DESCRIPTION OF THE PREFERRED EMBODIMENT

Figure 4:
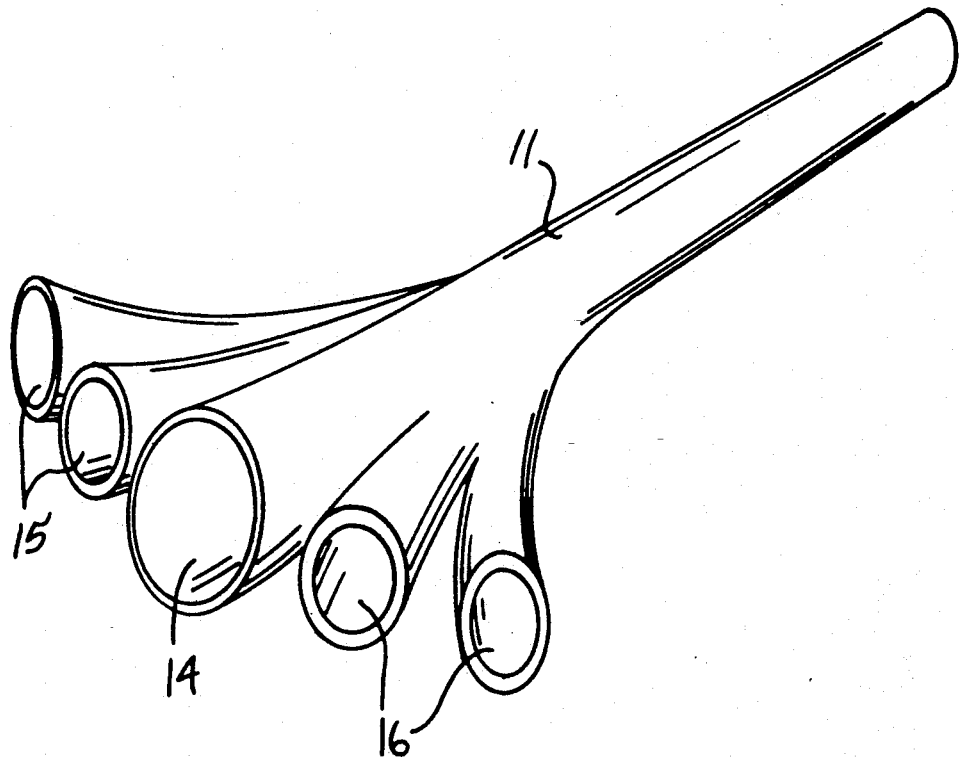
FIG. 4 is an isometric illustration of the instant invention.

With reference now to the drawings, and in particular to FIGS. 1 to 9 thereof, a new and improved megaphone apparatus embodying the principles and concepts of the present invention and generally designated by the reference numeral 10 will be described.

FIG. 1 illustrates a prior art megaphone apparatus, as set forth in U.S. Pat. No. 4,329,905, utilizing various vibrating membranes retained within the body of the megaphone to permit sound waves to cling to the horn inner surface and project outwardly therefrom.

More specifically, the megaphone apparatus 10 of the instant invention essentially comprises a central conical conduit 11, including an entrance opening 12 at a rear end thereof, wherein the conical conduit 11 is in aligned communication with an outwardly flared forward body 13 to define a central cavity between the central conical conduit 11 and the body 13. The body 13 includes a central outlet conduit 14 positioned medially of the body 13 coaxially aligned with the entrance opening 12. A plurality of right branch conduits 15 and a plurality of left branch conduits 16 are positioned to right and left sides of the central outlet conduit 14 defined about a central plane 17. In this manner, utilization of the invention directs a wide dispersion of broadcasting to enhance lateral directing of such audible vibrations through the apparatus 10. Further, the central outlet conduit 14 is defined by a first diameter greater than the entrance opening, with the branch conduits 15 and 16 defined by a second diameter less than the first diameter but greater than the entrance opening 12. The central outlet conduit 14 enhances forward directing of sounds, as well as lateral dispersion thereof, wherein the smaller diameter branch conduits enhance dispersion of the sound while minimizing degradation of sound directed through the central outlet conduit 14.

Figure 5:
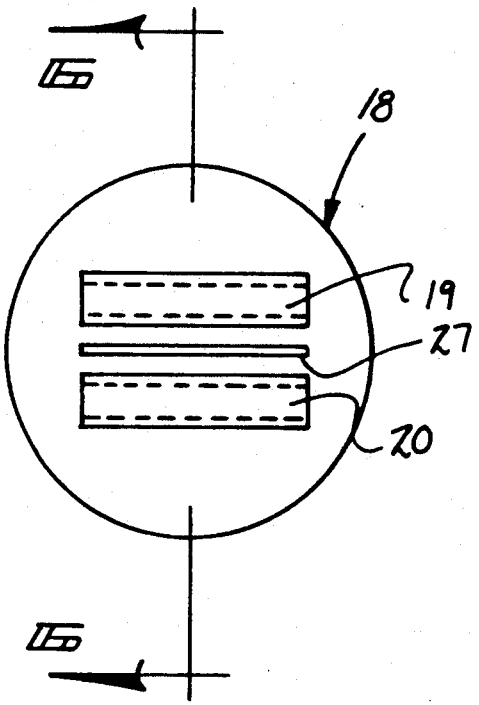
FIG. 5 is an orthographic front view of a residence cap utilized by the invention.
Figure 6:
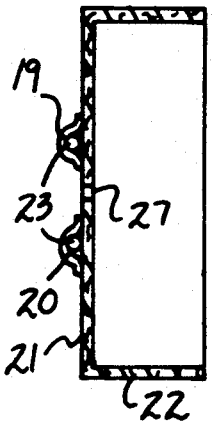
FIG. 6 is an orthographic view, taken along the lines 6—6 of FIG. 5 in the direction indicated by the arrows.
Figure 7:
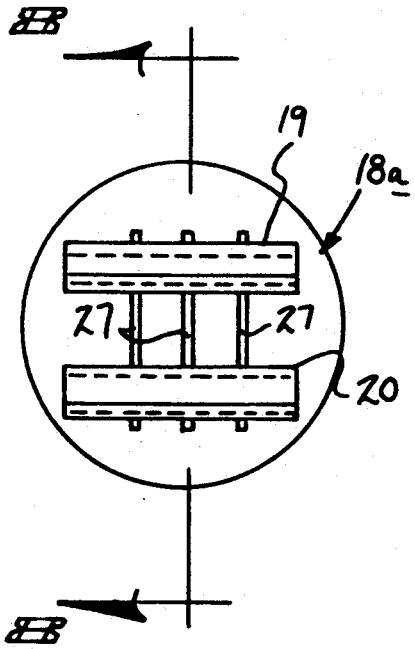
FIG. 7 is an orthographic front view of a further residence cap utilized by the invention.
Figure 8:
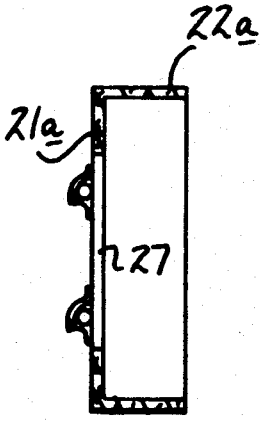
FIG. 8 is an orthographic view, taken along the lines 8—8 of FIG. 7 in the direction indicated by the arrows.
Figure 9:
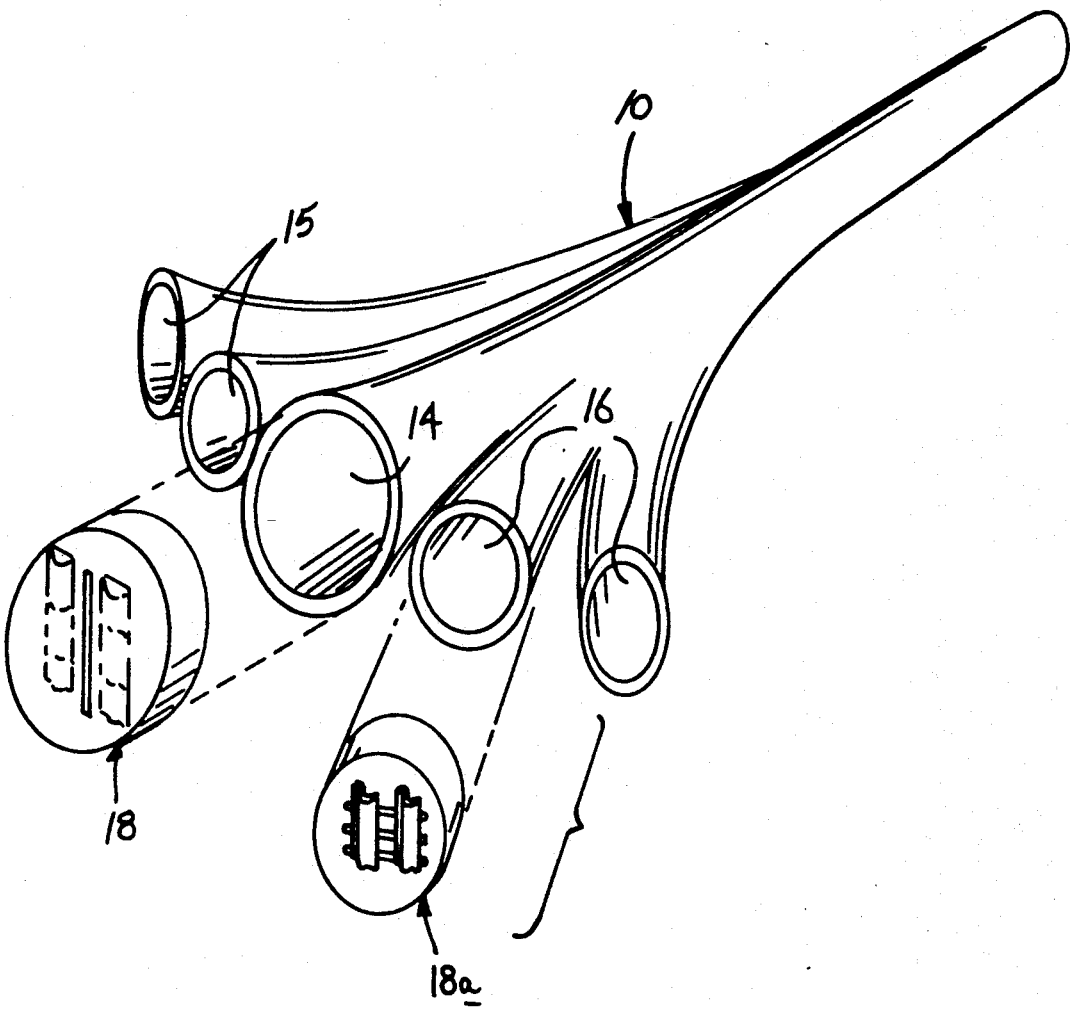
FIG. 9 is an isometric illustration of the invention mounting the residence caps thereon.

FIG. 5 illustrates a residence modulating cap 18 that is formed with an annular flexible web 21 defining a cap skirt 22 thereabout of a cylindrical configuration to receive the central outlet conduit 14. The web 21 includes a slit 27 diametrically directed through the web 21, with a first and second tubular pocket 19 and 20 respectively positioned on opposed sides of the slit 27 in a parallel relationship to themselves and the slit 27. Each pocket 19 is arranged for receiving a flexible rod 23 therewithin to thereby permit selective stiffening of the web 21 as desired to modulate audible sounds directed therethrough, as well as reflecting sounds within the central cavity of the conduit 11 and the body 13. Further, a modified cap 18 is provided with a flexible web 21*a* and a skirt 22*a* configured to receive a branch conduit therewithin. In the cap 18*a*, the first and second tubular pockets 19 and 20 are arranged also to receive flexible rods within, but include the slits 27 arranged in an orthogonal relationship relative to the pockets, as well as parallel relative to one another.

Further, it should be noted that support may be provided for the megaphone apparatus (not shown) in a fashion of a support plate defining a series of aligned intercommunicating openings to receive the central conduit and the branch conduits therethrough, in a manner for support and transport of the apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A megaphone apparatus, comprising, a central conical conduit, the central conical conduit including an entrance opening coaxially aligned with the conical conduit at a first end thereof, and the central conical conduit directed into an outwardly flaring forward body to define a central cavity defined by the conduit and the body, and a central outlet conduit directed through the forward body coaxially aligned with the entrance opening, and a plurality of right branch conduits directed from the body positioned adjacent the central outlet conduit to a right side thereof, and a plurality of left branch conduits directed from the body positioned adjacent a left side of the central outlet conduit, and each of the branch conduits and central outlet conduit in communication with the central cavity, and the central outlet conduit, the right branch conduits, and the left branch conduits are defined about a central plane diametrically bisecting the central outlet conduit, the right branch conduits, and the left branch conduits, and a residence modulating cap selectively securable about the central outlet conduit, the residence modulating cap including an annular flexible web, with a cylindrical cap skirt, the central outlet conduit defined by a first diameter and the cap skirt defined by an internal diameter equal to the first diameter, and the flexible web including a diametrically enclosed slit directed through the web.

2. An apparatus as set forth in claim 1 including a first pocket positioned above the slit and a second pocket positioned below the slit, wherein each pocket and the slit are in a parallel relationship relative to one another, and each pocket selectively receives a flexible rod therewithin to effect residence modulation of the flexible web.

3. An apparatus as set forth in claim 2 wherein each of the branch conduits is defined by a second diameter less than the first diameter.

4. An apparatus as set forth in claim 3 including a further residence modulating cap defined by a further flexible web and a further cylindrical skirt, the further cylindrical skirt defined by a second skirt diameter equal to the second diameter, and the further flexible web including a plurality of enclosed parallel slits directed through the flexible web, and an upper pocket and a lower pocket orthogonally intersecting the slits, wherein the upper pocket and lower pocket are arranged in a parallel relationship relative to one another to receive a flexible rod therewithin to effect modulation of the further flexible web.

* * * * *